United States Patent [19]

Ecklund et al.

[11] Patent Number: 4,845,750

[45] Date of Patent: Jul. 4, 1989

[54] MULTIPLE FUNCTION CONTROL CIRCUIT FOR AN AM STEREO RECEIVER

[75] Inventors: Lawrence M. Ecklund, Wheaton, Ill.; Roy H. Espe, Scottsdale, Ariz.

[73] Assignee: Motorola, Inc., Schaumburg, Ill.

[21] Appl. No.: 121,361

[22] Filed: Nov. 16, 1987

[51] Int. Cl.[4] ..... H04H 5/00

[52] U.S. Cl. ..... 381/15

[58] Field of Search ..... 381/15, 16; 455/161

[56] References Cited

U.S. PATENT DOCUMENTS

| | | | |
|---|---|---|---|
| 4,375,580 | 3/1983 | Sauer | 179/1 |
| 4,379,208 | 4/1983 | Isbell et al. | 179/1 |
| 4,430,747 | 2/1984 | Streeter | 381/15 |
| 4,606,075 | 8/1986 | Eastmond | 455/161 |
| 4,688,254 | 8/1987 | Ecklund | 381/15 |
| 4,712,241 | 12/1987 | Ecklund | 381/15 |

*Primary Examiner*—Forester W. Isen

*Attorney, Agent, or Firm*—Steven G. Parmelee

[57] ABSTRACT

In an AM stereophonic receiver a voltage is developed in response to negative overmodulation in the received signal, to detection of a pilot tone, to detection of a minimum or no signal strength condition, and to external control. Predetermined levels of this voltage are utilized to enable/disenable various function circuits within the receiver to optimize the operation.

22 Claims, 3 Drawing Sheets

MULTIPLE FUNCTION CONTROL CIRCUIT FOR AN AM STEREO RECEIVER

CROSS REFERENCE

This invention is related to the invention of U.S. Pat. No. 4,688,254 and incorporated herein by reference.

BACKGROUND OF THE INVENTION

This invention relates to the field of AM stereophonic receivers and, more particularly, to the control of various functions within the receivers in response to negative overmodulation levels of the received signal, signal strength, detection of a pilot tone or to externally applied control signals.

As AM stereo receivers developed, it became increasingly apparent that a number of functions within the receivers could be improved by the addition of some degree of control in response to the quality of the received signals. In the above-referenced patent, U.S. Pat. No. 4,688,254, a voltage was developed and stored in response to the detection of negative modulation in the in-phase signal. As is known, such modulation is due primarily either to noise in the trough of the modulation or to interfering signals, but not to a modulating program signal. At a predetermined level of the stored voltage the amount of correction applied to signals requiring a form of correction was reduced and, if the excessive modulation continued to increase, to reduce the amount of stereo information in the audio outputs, (a function commonly called blend). This same voltage source has been determined to be usable for controlling other functions within the receiver, as well as being controlled by other conditions.

SUMMARY OF THE INVENTION

These objects and others are accomplished in an AM stereo receiver circuit in accordance with the present invention wherein a voltage is developed in response to the detected negative overmodulation level of the received signal and/or to other indications of signal quality. Predetermined values within the range of voltages thus developed are utilized to improve the quality of the audio outputs and system control by controlling various functions within the receiver. These functions include pilot detection and indication, fast AGC, fast tuning lock-in, and the "Stop-Sense" control for "seek/scan" tuning.

DETAILED DESCRIPTION OF THE PREFERRED EMBODIMENT

Figure 1:
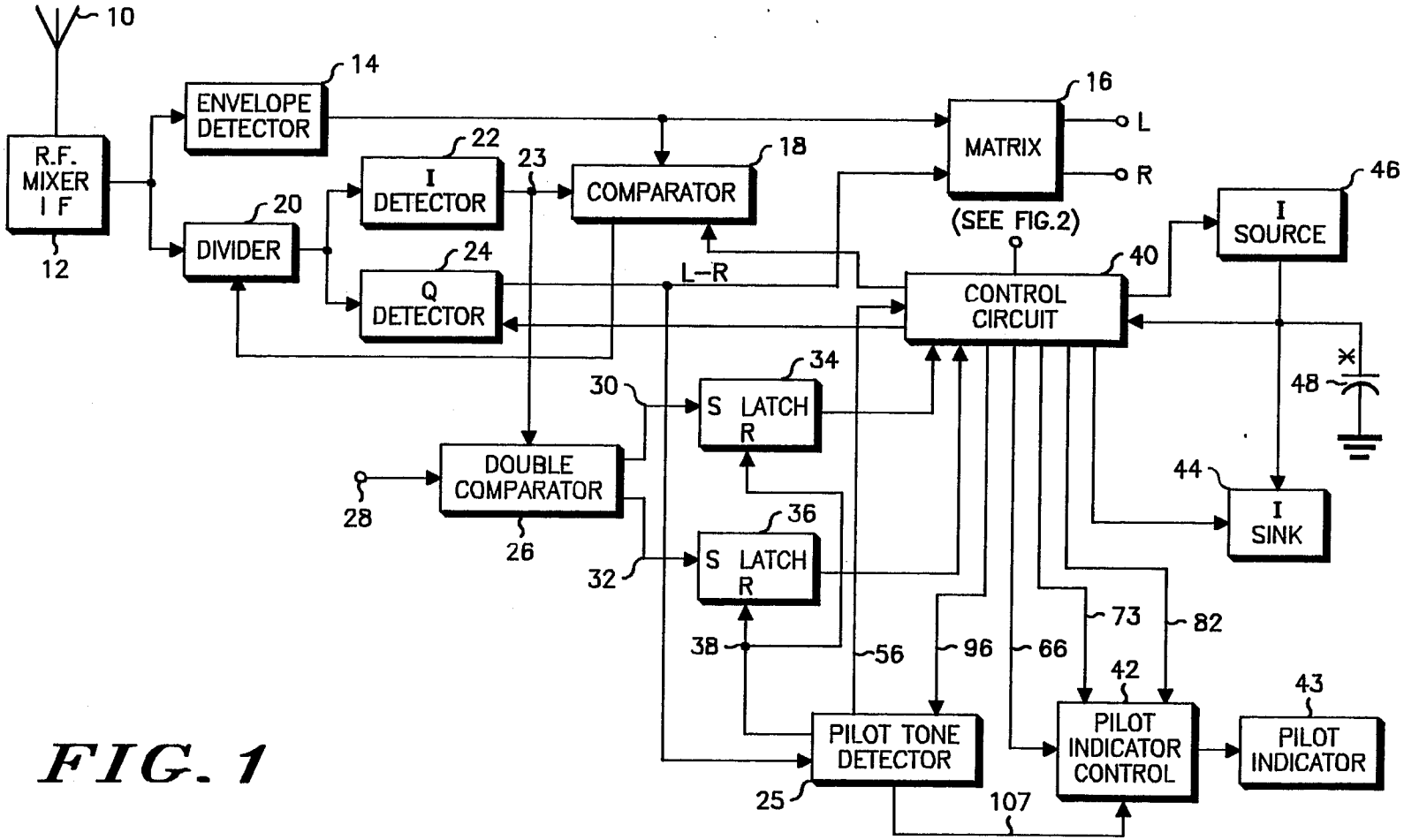
FIG. 1 is a block diagram of a receiver utilizing the present invention.

The block diagram of FIG. 1 represents a portion of an exemplary AM stereophonic radio receiver wherein a broadcast signal is received at an antenna 10. Neither the receiver shown nor the particular signal used therein are to be considered as limiting the present invention. The signal received by the receiver shown here can be represented by the following formula:

$$(1+L+R)\cos(w_c t+\phi)$$

where L and R are the original (modulating) information signals, w represents the carrier frequency and $\phi$ is the angle whose tangent is $[(L-R)/(1+L+R)]$. The RF signal is detected, mixed and amplified in normal fashion in RF/mixer/IF stages 12. The IF signal is coupled to an envelope detector 14 whose output is $1+L+R$, the normal monophonic signal. This output signal is coupled to a matrix 16 and a comparator 18. The IF signal is also coupled to one input of an analog divider 20 which receives the output of the comparator 18 at a second divider input. The divider 20 performs the cosine correction function as will be explained hereinbelow. The divider output is coupled to an in-phase (I) detector 22 whose output goes from a terminal 23 to a second input of the comparator 18. In the comparator 18, the envelope signal is compared with the in-phase signal, and the difference between the two signals, the "error", is the cosine correction signal. The correction signal, when coupled back to the divider 20, causes the output of the divider to be "corrected". The term "correction", as it applies to this exemplary receiver, means that the factor "cosine $\phi$" has been removed from the output signals of the divider 20. The divider 20 output is also coupled to an input of an L−R or Q (for quadrature) detector 24. The normal, corrected output of the Q detector 24 is L−R, and this signal is coupled to a pilot tone detector 25 and the matrix 16. As is known, the normal outputs of the matrix are L and R, the two original information signals.

The output signal from the I detector output terminal 23 is also coupled to a second comparator 26. A terminal 28 provides a reference signal for comparator 26. The comparator 26 is a dual output comparator which detects negative I overmodulation in the received signals and provides a first output signal at a terminal 30 each time there is more than 4% negative modulation. This situation can occur for several reasons such as noise or interfering signals. If the signal I reaches the 10% negative I modulation level, a second output signal is provided at a second output terminal 32. Each output signal from the dual comparator 26 is made up of short pulses, one for each time the respective reference level is exceeded. The output signal at the terminal 30 is coupled to a latch circuit 34, which creates a relatively long pulse for each short pulse from terminal 30. The output signal at the terminal 32 is coupled to a latch 36, also for providing long pulses from each short pulse. Each of the latches 34, 36 is reset from a low frequency clock pulse source 38. In a particular embodiment, any suitable low frequency signal, e.g. 100 Hz, which is available in the receiver could serve as the reset signal. A one-shot multivibrator or digital timing circuit could alternatively be used to form the long pulses.

Figure 2:
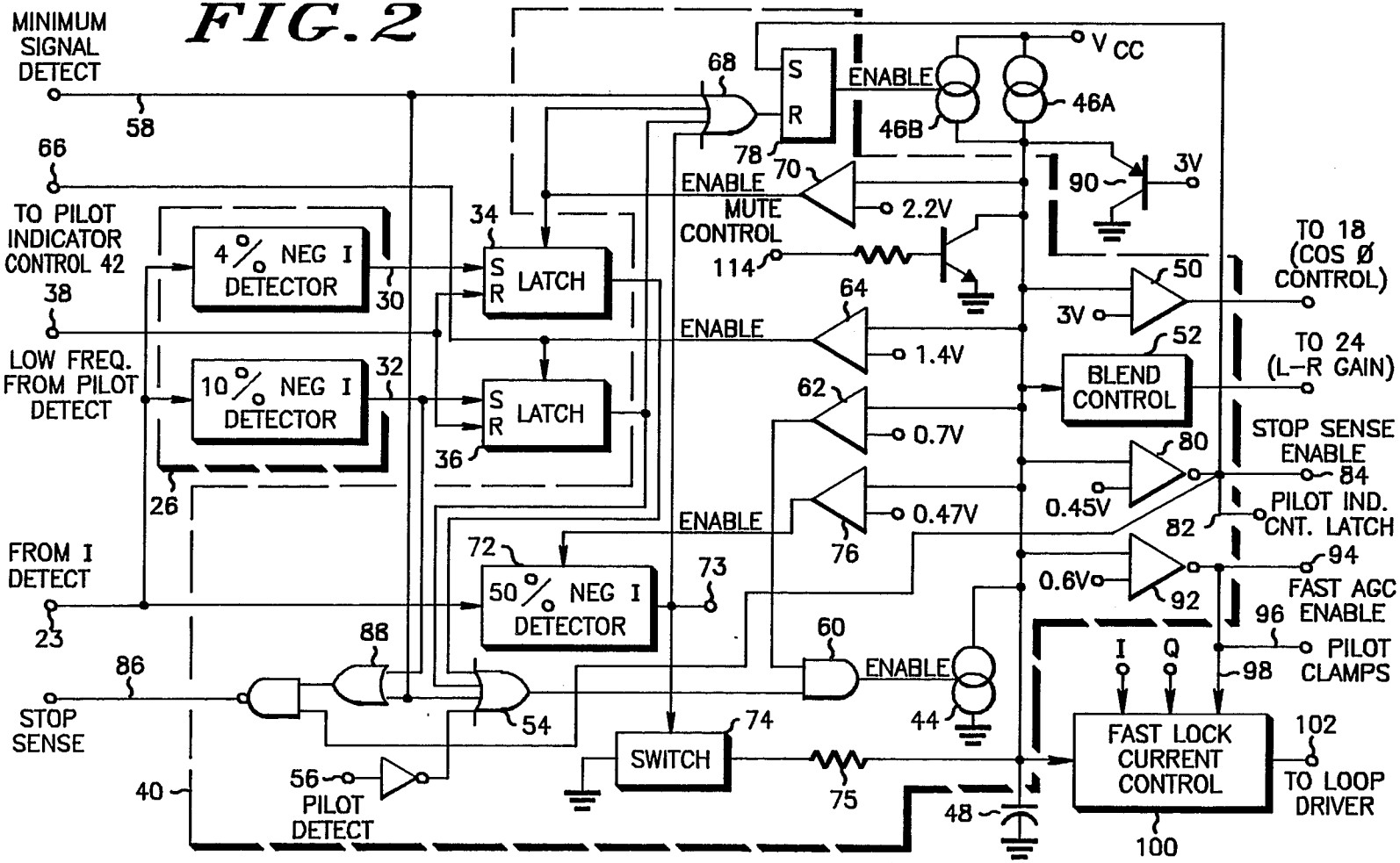
FIG. 2 is a more detailed logic/block diagram of a portion of the invention.

The output signals from the latches 34,36 are coupled to a control circuit 40 (see FIG. 2). The control circuit 40 controls the operation of a pilot indicator control 42 (see FIG. 3). The control circuit 40 also controls the operation of a current sink or "pull-down" circuit 44 and a two-part current source or "pull-up" circuit 46A, B. The source and sink are coupled for respectively charging and discharging a capacitor 48. The other end of the capacitor is coupled to ground or other suitable reference level. In the absence of any detected negative I modulation, capacitor 48 would be charged by current source 46A to approximately 3.6 v where transistor 90 wound (turn on) conduct the current to prevent any further rise. Each output pulse from either latch causes a slight discharge of the capacitor 48. The more frequent the pulses, the lower the capacitor voltage. Thus the voltage on the capacitor is proportional to the quality of the received signal. The supplied current might be, for example, 0.001 ma and each discharge pulse 0.5 ma.

The voltage on the capacitor 48 is coupled back to the control circuit 40, one output of which is coupled to a control input of the comparator 18 where it reduces and eventually turns off the cosine $\phi$ signal being coupled back to the divider 20. A second output of the control circuit 40 is coupled to the L−R detector 24, and can reduce and eventually turn off the L−R signal being coupled to the matrix. Thus, if the amount of overmodulation or negative I modulation increases, first the amount of correction will be reduced until it is turned completely off, then the difference signal L−R will be gradually reduced, then turned off. It may be seen, then, that these two functions are controlled in response to changing voltages on the capacitor 48. The optimum sequence of events and rates of turnoff are determined by subjective listening tests. These two functions are the subject of the co-pending application referenced above. In contrast, the added functions of the present invention are controlled in response to predetermined and specific voltage levels, and other functions are used to control the capacitor voltage as well.

The diagram of FIG. 2 is a more detailed block diagram, including in particular the control circuit 40 (shown within the dashed line). All logic shown is conventional positive logic. For simplicity, the double comparator 26 is shown here (also within a dashed line) as two separate negative I detectors, one providing an output when negative modulation over 4% is detected, and the other when over 10% is detected. The outputs of the comparator/detectors 26 are coupled to the Set inputs of the latches 34,36, and the latch outputs are coupled to the control circuit 40 as shown in FIG. 1. The outputs from a comparator 50, with a 3.0 V reference input, and from a blend control circuit 52 provide the correction and stereo functions shown in the above-referenced co-pending application. Both the comparator 50 and blend control circuit 52 receive an input from the capacitor 48 voltage. Within the control circuit 40 the latch 34,36 outputs are coupled to an OR gate 54, along with an inverted pilot indication signal from a pilot detector terminal 56 and a signal from a minimum signal detector terminal 58. The output of the OR gate 54 is coupled to gate 60 where it is ANDed with the output of a comparator 62 for enabling the current sink 44. The inputs for the comparator 62 are the voltage on the capacitor 48 and a 0.7 V reference voltage. Thus, when either of the latches 34,36 provides a negative modulation detection, when a minimum signal is being detected or when no pilot tone signal is being detected, the current sink 44 will be enabled to lower the capacitor 4 voltage. For no pilot or minimum signal detect the voltage will reach 0.7 where comparator 62 prevents further discharge.

Figure 3:
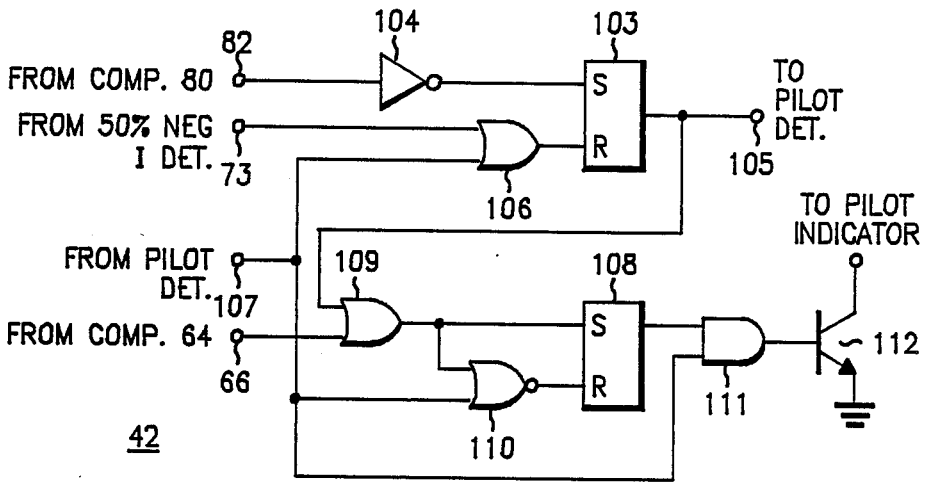
FIG. 3 is a detailed logic diagram of another portion of the invention.

The latch 36 is enabled by the output of a comparator 64 which is also coupled to the pilot indicator circuit of FIG. 3 via a terminal 66. The comparator 64 inputs are the capacitor 48 voltage and a 1.4 V. reference voltage so that the latch 36 is disenabled when the capacitor 48 voltage goes below 1.4 V. Therefore detection of 10% negative I can discharge capacitor 48 to no lower than 1.4 V. The latch 34 is enabled by the output of a comparator 70 which is also coupled to a first input of OR gate 68. The inputs of the comparator 70 are the capacitor 48 voltage and a 2.2 V reference, thus the latch 34 is disenabled if the capacitor 48 voltage goes below 2.2 V, the minimum voltage for 4% negative I detection. In addition to the input of the OR gate 54, the output of the latch 36 is also coupled to a second input of an OR gate 68. A third input to OR gate 68 comes from the Min. Sig. Det. signal at the terminal 58. A fourth input to the OR gate 68 comes from another I detector 72, which provides a detect signal at an output terminal 73 only if the negative I modulation should reach 50%. Such a condition would only occur during tuning with the decoder PLL out of lock or, possibly, with very severe interference. This 50% negative I detector also controls a switching circuit 74 whereby, at the 50% condition, the capacitor 48 voltage is quickly pulled down by switch 74 via a small resistor 75. When the capacitor voltage reaches 0.47 V, the negative modulation detector 72 is disenabled by the output of a comparator 76 whose inputs are the capacitor 48 voltage and a 0.47 V reference; the switching circuit 74 also being disenabled.

The output of the OR gate 68 provides the Reset input of a latch 78, the Set input coming from a comparator 80; the inputs for the comparator 80 being the capacitor 48 voltage and a 0.45 V reference.

The setting of latch 78 is done by externally pulling the capacitor 48 voltage below 0.45 v. This would typically be done when tuning to a new station with a signal from the frequency synthesizer. The same signal that controls audio muting during station charge would normally be used.

The output of latch 78 is the enabling signal for a second portion 46B of the current source 46 for pulling up the capacitor 48 voltage more quickly when that voltage has been pulled below 0.45 V. Preferably, the combined current of the two portions of the current source 46 is less than the current of the current sink 44. This is to allow a quick unblending into stereo when changing to a station with a good quality signal. The quick rise is terminated via the reset from gate 68 with detection of any of the poor quality indicators (inputs to gate 68), or at 2.2 V, at which the signal is fully unblended.

Other comparator 80 outputs include (via a terminal 82) the Set signal for a pilot indicator control latch (see FIG. 3), and (via a terminal 84) the enabling signal for a "Stop-Sense" signal which is provided at an output terminal 86 of an OR gate 88. The OR gate inputs are the output of the 10% negative I portion of the double comparator 26 and the Min. Sig. Det. signal from the terminal 58. A Stop-Sense signal, as is known, is frequently used in radios which include "Seek" and/or "Scan" features. This Stop-Sense signal is provided only when the radio is locked on a station, when signal strength is sufficiently high and when the level of interference is sufficiently low. Thus the radio will not stop on frequencies where there is strong interference. These features are described more fully in another co-pending application, Ser. No. 902,860, assigned to the assignee of the present invention.

In the preferred embodiment the stop-sense signal goes to the same output terminal as a signal strength indicating voltage. When the voltage 48 is above a predetermined minimum it is an indication of received signal strength that can be used for such functions as meterdrive or RF AGC. When the signal goes below the predetermined minimum it is an indication of weak or noisy signals, and is used to tell the frequency synthesizer to scan to the next station. The pull down of the output terminal by the stop-sense circuit is enabled only when the pin 48 voltage is below 0.45 v.

Still another comparator 92, with inputs of 0.6 V and the capacitor 48 voltage, controls three additional functions. When the capacitor voltage goes below 0.7 V, which can only happen with 50% negative I detection or external control, it is assumed that the stereo decoder is out-of-lock. At 0.6 V, the comparator 92 output signal at a terminal 94 is coupled to a "fast AGC" circuit (not shown) which allows the receiver AGC to quickly settle on a new level when tuning to a different station; that is, the rate of change of the AGC voltage with respect to carrier level changes is increased. A terminal 96 couples the comparator 92 to the pilot detector (not shown) to disenable the pilot detector function until the capacitor voltage returns to a value greater than 0.6 V. A third output terminal 98 couples the comparator 92 to a "fast lock" current control circuit 100. At the predetermined voltage (0.6 V), clamps on the fast-lock current in a PLL (not shown) are released, and the current increases as an inverse function of the capacitor 48 voltage to a maximum of about 2 ma at 0.3 V. The circuit 100 receives I and Q inputs as well as the capacitor 48 voltage, and the output to a PLL driver circuit (not shown) is via a terminal 102. The PLL could be similar to that of U.S. Pat. No. 4,377,728, assigned to one assignee of the present invention, and designed to provide fast "pull-in" even when there is a relatively large difference between the reference frequency and the VCO frequency. In that patent, logic circuits determine whether the VCO is too high or too low and provides the appropriate DC voltage to pull the VCO to the proper frequency. The present invention provides a source of control current for the fast lock-in circuit of the last-mentioned patent at the output terminal 102. The current at the terminal 102 is responsive to the capacitor 48 voltage when that voltage is below 0.6 V.

The embodiment of the pilot indicator control circuit 42 as shown in FIG. 3 will activate some form of indicator 43, a lamp for example, to tell the user that the receiver is tuned to a station which is transmitting AM stereo signals. In a preferred version, the indicator 43 will stay on as long as the received signal contains a stereo pilot tone unless the system detects 50% negative modulation. In the circuit 42 a first latch 103 is set by the inverted output signal of the comparator 80 via terminal 82 and an inverter 104 when the capacitor 48 voltage is less than 0.45 V, and the output of the latch 103 at a terminal 105 enables a circuit in the pilot detector (not shown) to allow the pilot detector 21 to lock on to the pilot tone more quickly than it would otherwise do. A second latch 108 is set by the output of the latch 103, ORed in gate 109 with the output of the comparator 64 via the terminal 66. The output of the latch (108) is ANDed in gate 111 with the signal at the terminal 107 to turn on a switching circuit 112 for activating the indicator 43. This allows the indicator to come on as soon as pilot is detected. The latch 103 can be reset by an input from the 50% negative I detector 72 via terminal 73, ORed in gate 106 with an input at a terminal 107 from the pilot detector circuit 21. The reset signal for the latch 108 is the set signal NORed in gate 110 with the pilot detect signal at terminal 107.

The reset of latch 108 requires that latch 103 be reset by a loss of pilot detection and the capacitor 48 voltage drop below 1.4 v. Once latch 108 has been reset it requires that the capacitor 48 voltage rise to 1.4 v to turn on the pilot indicator. This prevents occasional flashing of the indicator in instances were severe interference might produce occasional false outputs from the pilot detector.

Figure 4:
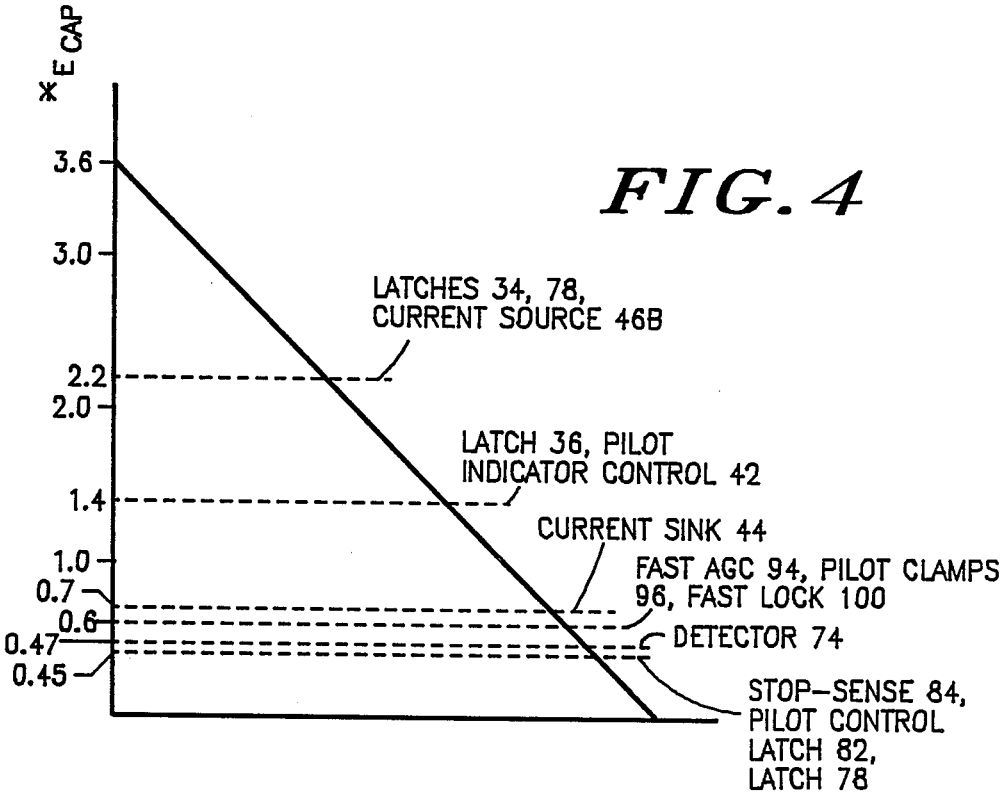
FIG. 4 is a chart illustrating the enabling and disabling voltages at which the various functions are controlled and the operating ranges of the control circuits.

The chart of FIG. 4 illustrates the operation in terms of the voltage on the capacitor 48 in this embodiment. For clarity, the chart illustrates essentially a laboratory condition wherein a controlled voltage source is applied to the capacitor 48, and gradually turned down. It is to be understood that the actual voltage does not vary along a straight line such as this, but will decrease by a very small increment each time a negative overmodulation condition is detected and will increase gradually as the capacitor is recharged during normal modulation conditions.

Under the conditions that a stereo station is properly tuned in and that no overmodulation is occurring, the voltage on the control capacitor 48 will stay constant at about 3.6 volts, limited by the clamp circuit 90. As described in the above-referenced co-pending application, when negative modulation occurs and the voltage on the capacitor is reduced, the operating conditions remain unchanged until about the 3.0 V point is reached, when the cosine correction function will be reduced until at about 2.8 V there will be no correction. Below 2.1 V the gain in the L−R channel will be reduced, ending at about 1.4 V with monophonic reproduction. The monophonic mode of operation will continue as the capacitor 48 voltage drops to a limiting value, and until the capacitor voltage is restored by the current source 46 under normal signal conditions.

According to the present invention, the desired improvement in the operation of a stereophonic receiver will be achieved as the functions described herein are enabled or disenabled at predetermined levels of the capacitor 48 voltage.

When capacitor 48 is pulled below 0.45 v the stop sense circuit is enabled. Fast lock current is increased. Latch 103 is set to allow immediate pilot indication when pilot is detected. Latch 78 is set in order to turn on current source 46B for fast pull-up of capacitor 48. At, but not controlled by, this voltage the fast AGC is enabled and the pilot detector is disabled. L−R and Cos $\phi$ correction are turned off.

When the external pull down is released the voltage will rise and, if the PLL is not in lock, will stop at 0.47 v. Stop sense is disabled. If the PLL has locked the voltage will continue to rise to 0.7 v. As the voltage passes 0.6 v the fast AGC is turned off, the fast lock is turned off, and the pilot detector is enabled.

The voltage will stay at 0.7 v if a minimum signal condition is detected or, if not, until pilot is detected. Upon pilot detection current sink 44 is turned off, the pilot indicator is turned on, and latch 103 is reset.

As capacitor 48 voltage reaches 1.4 v the 10% negative I latch 36 is enabled and L−R gain starts to rise from zero. If 10% negative I is detected, latch 78 is reset, turning off fast pull-up current source 46B. The capacitor 48 voltage will be held at 1.4 v if the 10% interference is continuous.

If no interference is detected the voltage will continue to rise quickly until 2.2 v is reached. At 2.2 v the latch 78 is reset, turning off current source 46B, and the 4% negative I detector is enabled. L−R gain has increased to full gain for normal stereo. If continuous 4% interference is detected the voltage will stay at 2.2 v.

Even if interference is not detected the voltage will rise more slowly to 3.6 v since 46B has been turned off, and where transistor 90 prevents further increase. As the voltage passes 3.0 v the cos $\phi$ correction signal is enabled to give proper L−R decoding.

Interference, loss of pilot, or minimum signal detection enables current sink 44 or switch 74 and pulls the capacitor 48 voltage down to 2.2 v, 1.4 v, 0.7 v or 0.47 v. If the condition that caused the pull-down disappears the voltage again rises. The difference in operation from that previously described is that the voltage will rise more slowly since current source 46B is off, and the pilot indicator will not turn on (if loss of pilot was the reason for the drop in voltage) until the voltage reaches 1.4 v.

Thus there has been shown and described a means for utilizing a single voltage source, derived basically from negative overmodulation and pilot detection on the received signal but also externally controllable, to enable/disenable a plurality of related functions in a stereophonic receiver. In this way, the maximum improvement in the operation of the receiver is achieved with a minimum of complexity and expense. Other variations and modifications are possible and it is intended to cover all such as fall within the scope of the appended claims.

What is claimed is:

1. A multiple control circuit as for use in an AM stereo receiver having a plurality of switchable function circuits, the circuit comprising:

detector means for detecting the level of negative overmodulation in received signals and for providing an output signal in response thereto;

storage means coupled to said detector means for storing a voltage related to said output signal;

means coupled to said storage means and to one of said function circuits for enabling/disenabling said one function circuit in response to a predetermined level of said stored voltage.

2. A multiple control circuit as for use in an AM stereo receiver including means for receiving a signal consisting of a carrier modulated in-phase and in quadrature, and having a plurality of switchable function circuits, the control circuit comprising:

detector means for detecting the level of negative overmodulation on said in-phase modulated carrier, and for providing an output signal in response thereto;

storage means coupled to said detector means for storing a voltage related to said output signal;

a plurality of circuit means coupled to said storage means and to said function circuits for enabling-/disenabling ones of said function circuits in response to respective predetermined levels of said stored voltage.

3. A multiple control circuit in accordance with claim 2 and wherein said detector means includes comparator means for providing an output pulse at each detection of negative overmodulation and each said pulse is capable of partially discharging said storage means.

4. A multiple control circuit in accordance with claim 2 and wherein said detector means includes first and second portions for detecting negative overmodulation beyond first and second levels, respectively, the first and second portions providing separate outputs.

5. A multiple control circuit in accordance with claim 4 and wherein two of said plurality of circuit means enable/disenable the portions of said detector means respectively.

6. A multiple control circuit in accordance with claim 4 and wherein the control circuit further includes second detector means for detecting negative overmodulation beyond a third level, the third level being more negative than the first and second levels.

7. A multiple control circuit in accordance with claim 6 and further including increased rate discharge means for discharging said storage means at an increased rate, and wherein the second detector means enables/disenables said increased rate discharge means.

8. A multiple control circuit in accordance with claim 6 and wherein one of said plurality of circuit means enables/disenables said second detector means.

9. A multiple control circuit in accordance with claim 2 and wherein said storage means includes a capacitor.

10. A multiple control circuit in accordance with claim 9 and wherein said storage means further includes means for supplying current to said capacitor and means for sinking current from said capacitor.

11. A multiple control circuit in accordance with claim 10 and wherein at least one of said plurality of circuit means enables/disenables at least a portion of said current supplying means.

12. A multiple control circuit in accordance with claim 10 and wherein at least one of said plurality of circuit means enables/disenables at least a portion of said current sinking means.

13. A multiple control circuit in accordance with claim 2 and wherein the receiver includes a stop-sense control circuit, and one of said plurality of circuit means enables/disenables said stop-sense control circuit.

14. A multiple control circuit in accordance with claim 2 and wherein the receiver includes a pilot indicator control circuit, and one of said plurality of circuit means enables/disenables said pilot indicator control circuit.

15. A multiple control circuit in accordance with claim 2 and wherein the receiver includes a pilot indicator control latch, and one of said plurality of circuit means enables/disenables said pilot indicator control latch.

16. A multiple control circuit in accordance with claim 2 and wherein the receiver includes a fast AGC circuit that increases rate of change of receiver gain, and one of said plurality of circuit means enables/disenables said fast AGC circuit.

17. A multiple control circuit in accordance with claim 2 and wherein the receiver includes a pilot detection circuit, and one of said plurality of circuit means enables/disenables said pilot detection circuit.

18. A multiple control circuit in accordance with claim 2 and wherein the receiver includes a phase locked loop and a fast lock current control circuit for said phase locked loop, and one of said plurality of circuit means enables/disenables said fast lock current control circuit.

19. A multiple control circuit in accordance with claim 2 and wherein the receiver includes discharge means for rapidly lowering said stored voltage.

20. A multiple control circuit in accordance with claim 19 and wherein the receiver includes received frequency control means for tuning and said discharge means is activated by a signal from said received frequency control means.

21. A multiple control circuit in accordance with claim 2 and wherein at least one of said plurality of circuit means includes a respective reference voltage source and a comparator means coupled to said reference source and to said storage means.

22. A multiple control circuit in accordance with claim 2 and further including means for placing a top limit on said stored voltage.

* * * * *